United States Patent [19]

Siegien

[11] 4,206,727

[45] Jun. 10, 1980

[54] TWO-STROKE-CYCLE ENGINE HAVING AN AUXILIARY PISTON AND VALVE ARRANGEMENT, AND ITS ASSOCIATED DRIVE MECHANISM

[76] Inventor: Miguel Siegien, De la Serna 979 -Avellane-da-Provincia, Buenos Aires, Argentina

[21] Appl. No.: 967,982

[22] Filed: Dec. 11, 1978

[30] Foreign Application Priority Data

Dec. 12, 1977 [AR] Argentina ..... 270337

[51] Int. Cl.[2] ..... F02B 33/04

[52] U.S. Cl. ..... 123/66; 123/47 R; 123/65 VB; 123/68; 123/71 R

[58] Field of Search ..... 123/66, 68, 71 R, 47 R, 123/39 R, 65 VB

[56] References Cited

U.S. PATENT DOCUMENTS

| | | | |
|---|---|---|---|
| 779,116 | 1/1905 | Bronder | 123/66 |
| 961,677 | 6/1910 | Bradley | 123/66 |
| 990,082 | 4/1911 | Traub | 123/66 |
| 1,178,691 | 4/1916 | Tarington | 123/66 |
| 1,257,360 | 2/1918 | Jones | 123/66 |
| 1,616,064 | 2/1927 | Purdy | 123/66 |
| 1,726,073 | 8/1929 | Kinder | 123/66 |
| 1,740,040 | 12/1929 | Sapienza | 123/66 |
| 1,891,510 | 12/1932 | Tucker | 123/66 |
| 2,445,148 | 7/1948 | Minnix | 123/66 |

*Primary Examiner*—Wendell E. Burns
*Attorney, Agent, or Firm*—Fleit & Jacobson

[57] ABSTRACT

The invention provides a two-stroke-cycle engine which has a main piston, and an auxiliary piston and transfer valve arrangement. and its associated drive mechanism. The engine has also at least two intake valves arranged in the cylinder head. The auxiliary piston and transfer valve assembly comprises an auxiliary piston having an external hollow stem linearly slidable in a bushing mounted in said cylinder head and the transfer valve is provided with a stem freely slidable within said hollow stem. The drive mechanism operates the auxiliary piston to suck-in a new charge of combustible mixture into the cylinder space between the auxiliary piston and the cylinder head during the first or downward stroke of the main piston, and simultaneously aiding the discharge of the burned gases from the previous cycle through the exhaust port with the transfer valve in its closed position, after which the intake valves close and the fresh combustible charge in said cylinder space is compressed during a first portion of the second or upward stroke of the main piston, whereafter the transfer valve opens during the last portion of the cycle allowing the transfer of the combustible mixture from said upper cylinder space to the space comprised between the auxiliary and the main pistons.

1 Claim, 3 Drawing Figures

TWO-STROKE-CYCLE ENGINE HAVING AN AUXILIARY PISTON AND VALVE ARRANGEMENT, AND ITS ASSOCIATED DRIVE MECHANISM

BACKGROUND OF THE INVENTION

1. Field of the Invention

This invention relates to a two-stroke-cycle engine which provides a higher thermal efficiency, less fuel consumption, less ambient pollution and which is smaller and lighter than a comparable engine of the same power output.

2. Description of the Prior Art

Two-stroke-cycle engines are well known by those skilled in the art.

The engines of this type have some well known drawbacks when compared with the four-stroke-cycle engines. One of these drawbacks is that the discharge of the burned gases from the cylinder is very defficient. Another well known drawback is that there is always a certain loss of fresh and unburned combustible mixture through the exhaust port. The conventional two-stroke-cycle engine produces also more vibration than a four-stroke-cycle engine and it contributes very much to produce a higher atmospheric pollution.

This invention provides a practical solution of these and other drawbacks of conventional engines of this type.

SUMMARY OF THE INVENTION

The present invention relates to two-stroke-cycle engines.

The new two-stroke-cycle engine of the present invention offers a good number of advantages when compared with the conventional types of this kind of engine. Between the advantages the following may be mentioned:

(1) The motor of this invention allows a fuel saving which may amount to more than 50% of the fuel consumption of a conventional two of four-stroke-cycle engine, both of the type operating on gasoline or of the type operating on fuel oil;

(2) It reduces as far as an 80% the environmental pollution which is a goal at which must aim any modern design of an internal combustion motor;

(3) It has a weight which is at least 40% less than the weight of a conventional engine of the type mentioned;

(4) Since it allows a truly complete exhaust of the burned gases through an exhaust port provided in the lower part of the cylinder, it will yield a substantially higher power output due to the fact that it allows to make use of a greater amount of the latent heat contained in the gases which represents a thermal energy which normally is partially wasted but which in this new engine is transformed into useful mechanical power;

(5) It has two rotating type intake valves in its cylinder head, both valves rotating in the same direction thus avoiding the inertia phenomenons normally encountered when dealing with conventional engines provided with valves of the reciprocating type.

(6) It produces considerably less vibrations during its operation when compared with an engine of the conventional type.

The high percentage of fuel saving is due to the following causes:

(a) The power stroke during each revolution of the crankshaft is produced by a pure mixture of fuel and air not contaminated by burned gases; thus, for generating the same amount of power less amount of fuel will be necessary;

(b) It completely discharges the burned gases through an exhaust port provided in the bottom portion of the cylinder. This means a lower temperature of the new incoming fuel-air mixture thus substantially avoiding excessively hot localized zones and/or points in the combustion chamber, as is normally the case with the conventional engines of this type in which the discharge of the burned gases is produced through an exhaust port provided in the upper portion of the cylinder. A higher compression ratio may be obtained in the present engine which means a higher pressure per unit surface of the piston head;

(c) Another reason is that in the present two-stroke-cycle engine the lenght of the stroke of the piston bears no relationship with the fuel-air intake mixture volumen, as is the case with conventional engines. In other words, in the present engine the intake of the combustible mixture into the cylinder is not produced by the piston but by a special auxiliary piston and valve arrangement which operates in the vertical direction, that is to say a special reciprocating arrangement for the intake of the combustible mixture and the exhaust of the burned gases. In a conventional engine, if it is desired to obtain a greater pressure of the burning mixture on the piston head, it will be necessary to use a piston that has a greater diameter, but to maintain the same fuel consumption its stroke must be made proportionally shorter. But when the stroke is made shorter, the lever arm of the crank on which is mounted the connecting rod receiving the force of the pressure exerted by the gas on the piston will also be less. Thus, as has been confirmed in the conventional motor, it is not possible to obtain more power by varying the piston stroke or the surface thereof, without changing also the fuel consumption;

(d) The fourth reason why the engine of the present invention allows a considerable saving of fuel consumption is that the operation of the rotating type intake valves does not develop inertial forces since each of them is continuously rotating in one and the same direction, and thus there is no increase of the inertia forces in response to an increase of the revolutions of the engine.

The second advantage mentioned in (2) above, that is the elimination of environmental pollution, is that in the present engine the burned gases are exhausted from the cylinder substantially in their enterity through the exhaust port provided in the bottom portion of the cylinder, into which thus enters afterwards only a fresh and pure new charge of fuel-air mixture for the next combustion. This not only increases the generated power, since the mixture, devoid of burned gases, may be compressed to a higher degree with a lesser amount of fuel, but the combustion is also more complete since particles of the combustible mixture are not sorrounded by inert burned gases, thus allowing a truly complete combustion substantially not polluting the atmosphere with the products of an incomplete combustion.

Another advantage of the present engine, which allows to avoid the environmental pollution, is the fact that the intake stroke is nearly equal to the power stroke. Thus there is enough space for the expansion of the gases when the piston is on its power stroke, giving the mixture enough time to burn completely. In a conventional engine, after the combustion has taken place, there remain in the cylinder too many unburned gases which reduce the percentage of the following charge of fresh mixture which may be ignited during the next cycle, thus reducing the efficiency of the engine, and which partly escape to the atmosphere during the exhaust cycle thus seriously contributing to the ambient pollution.

The advantage stated above in point (3) means that it is possible to reduce in more than 40% the size of the present engine for the same power output. This not only is an advantage from the standpoint of saving of space, but also it means an important saving of materials used in its construction, and thus an important reduction of cost, in any use such as in automobiles, ships, locomotives and the like. The mechanisms used allow the construction of engines with only one cylinder or of engines with many cylinders. The cylinders may be arranged in line, in "V", or may be opposedly or radially arranged.

The advantage stated above in point (4) derives from the fact that the exhaust port is provided in the lower portion of the cylinder, thus allowing a substantially complete discharge of the burned gases from the cylinder during the exhaust stroke. This makes possible a complete ignition of the next fresh charge of fuel-air mixture sucked into the cylinder during the following intake stroke. Since the exhaust port is provided in the lower portion of the cylinder, this later will attain a lesser operating temperature since the gases, during their expansion, will stay within the cylinder during less than one half of the time when comparing with engine of conventional construction. This allows a better utilization of the latent heat of the combustible mixture and a higher power output.

The advantage stated above in point (5 ) derives not only from the fact that the two rotating intake valves arranged in the cylinder head have very low inertia which do not depend on the number of revolutions of the engine, but also from the fact that when these valves open at the instant in which the intake stroke starts, a maximum volume of combustible mixture may enter into the cylinder in a minimum time, thus increasing the power output obtainable from the engine.

The advantage stated above in point (6) stems from the facct that in the case of an engine of the present type which has only few cylinders, the vibrations generated during its operation are less than with an engine of conventional construction and having the same number of cylinders. The operation of the present engine is considerably smoother and quiter than that of an engine of conventional construction having the same number of cylinders.

DETAILED DESCRIPTION OF A PREFERRED EMBODIMENT OF THE INVENTION

Figure 1:
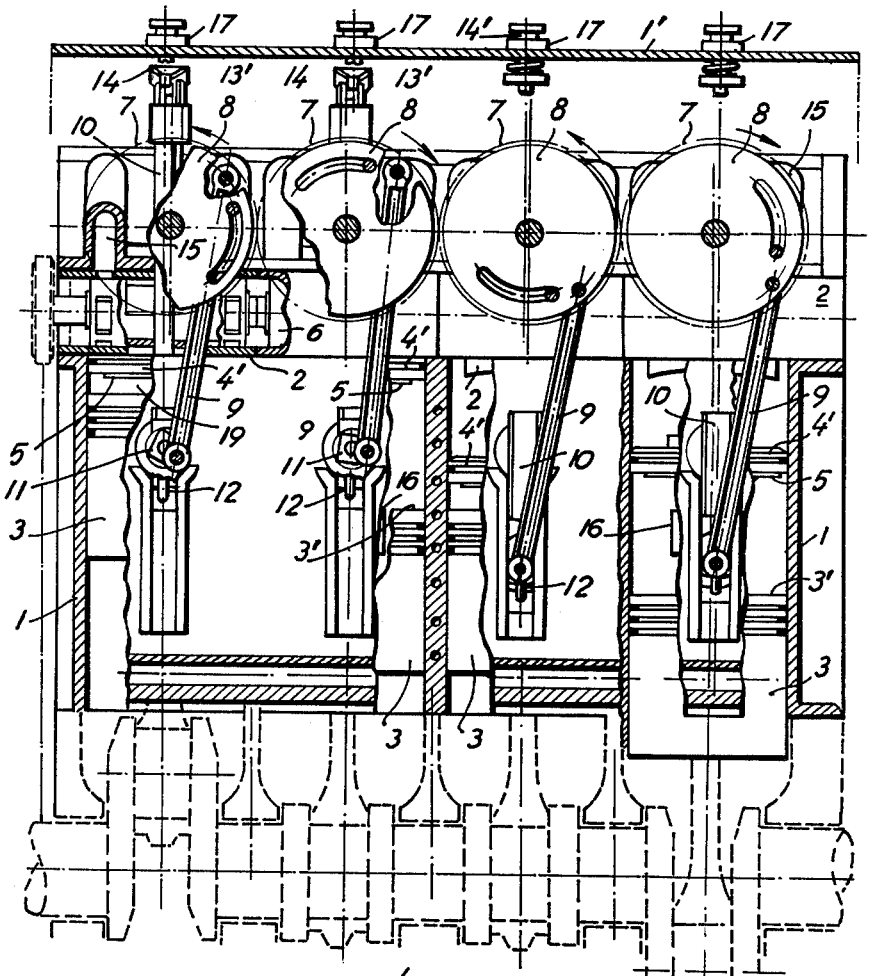
FIG. 1 is a side elevation view of a longitudinal cross-section of an engine according to the present invention.

Refering now to the drawings, it can be seen that the engine of the present invention comprises a cylinder block 1 having a cylinder head 2. Within each cylinder of block 1, a piston 3 is reciprocatably arranged. In cylinder head 2 is vertically slidably mounted the hollow external stem 4 of an auxiliary piston 4' having at least one transfer port 4'', while at least one rotating intake valve 6 is rotatably mounted in said cylinder head 2. Within hollow stem 4 is slidably mounted an inner stem 5' of a transfer valve 5. When valve 5 is in a first position, seated against the lower face of auxiliary piston 4', it closes the transfer ports 4'' thus closing communication between the space above the auxiliary piston 4' and the space below the same. A small portion 5'' of inner stem 5' protrudes from the upper end of external stem 4. Laterally of block 1 a drive gear 7 is rotatably mounted to drive the mechanism producing the reciprocating movement of auxiliary piston 4', drive gear 7 being provided with a crank pin carrying disc 8, the crank pin of which drives the connecting rod 9. Within a guide sleeve 10 laterally provided in block 1 a push rod 13 is slidably mounted, its lower end being rotatingly associated with the lower end of connecting rod 9. The upper end of push rod 13 is connected to one end of a transversal bridge member 13' the other end of which is connected to the upper end of external stem 4. On the upper face of bridge member 13' is mounted a rocker arm 14, with an adjustable stop member 14' mounted in an upper cover 1' of the engine. The fuel-air mixture enters the cylinder through the intake manifold 15, the rotating intake valves 6, the special intake and exhaust valve 5 and transfer ports 4'' when these are uncovered by the transfer valve 5 in a second relative position thereof, while the burned gases are discharged from the cylinder through the exhaust port 16 when piston 3 comes near its bottom dead center. The driving mechanism for the auxiliary piston 4' is housed within a gear housing 18. A fuel-air mixture compression chamber 9 is formed between the main piston head 3' and the lower face of auxiliary piston 4' and transfer valve 5. A spark plug (not shown) is mounted within cavity 20 provided in the upper portion of the cylinder.

Figure 2:
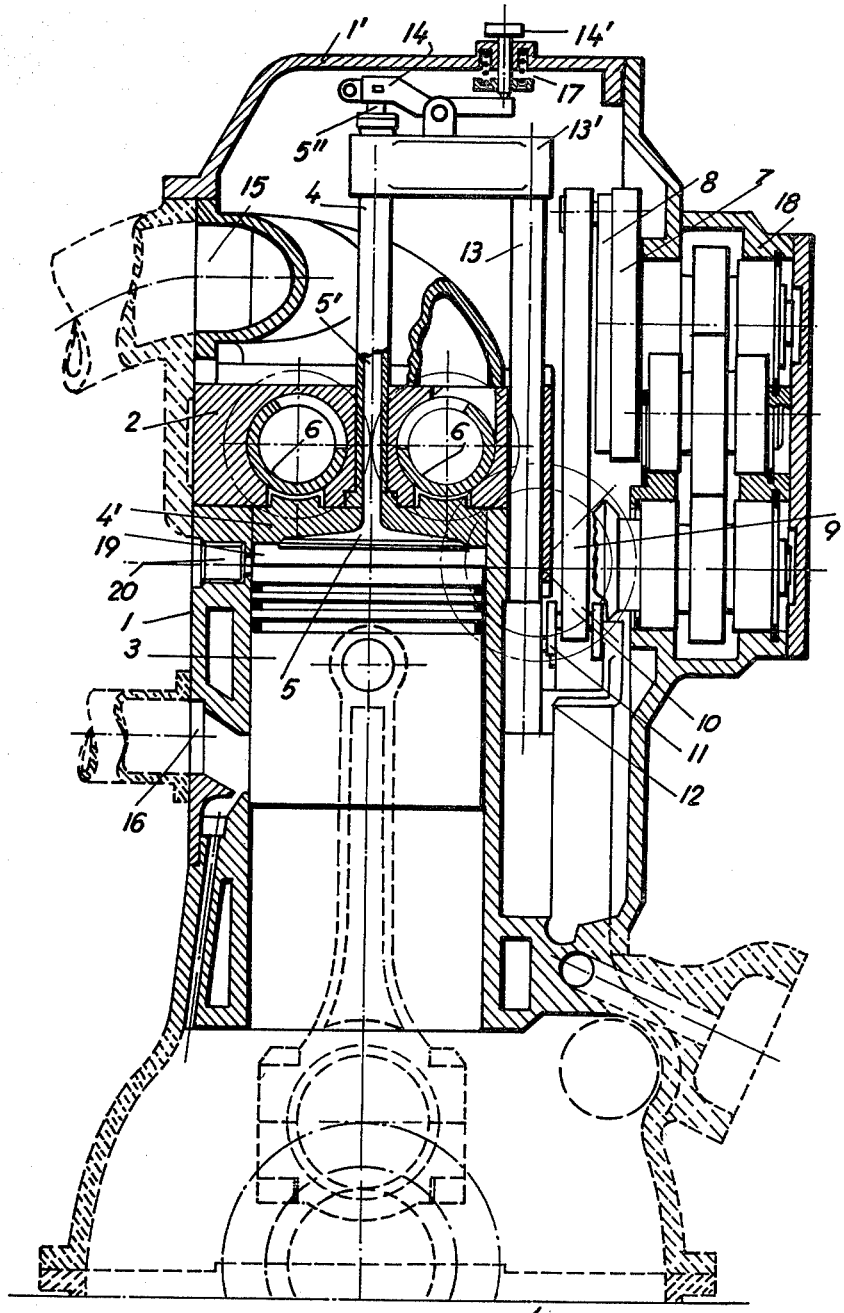
FIG. 2 is a front elevation view of a diametral cross-section of one of the cylinders of the engine shown in FIG. 1, with the main piston at its top dead center position, ready to start the power stroke.

The operation of the present invention engine through a complete cycle is as follows. It will be described starting from the position of the components shown in FIG. 2. Piston 3 is in its top dead center position, chamber 19 containing a fresh charge of compressed fuel-air mixture which has entered the cylinder through the previously open and now closed rotating intake valves 6, the mixture charge being substantially free of burned gases from the previous cycle. Auxiliary piston 4' and transfer valve 5 are in the upper end position of their vertical stroke, sealingly closing chamber 19.

The first stroke of the cycle begins when a spark is established between the electrodes of the spark plug mounted in cavity 20, igniting the fuel-air mixture in chamber 19. Main piston 3 is thus pushed downwardly by the burned gases and additionally forcing them through exhaust port 16 while at the same time the upper face produce a sucking action in the upper portion of the cylinder to introduce more energetically a fresh fuel-air mixture into the cylinder through the now open rotating intake valves 6.

Figure 3:
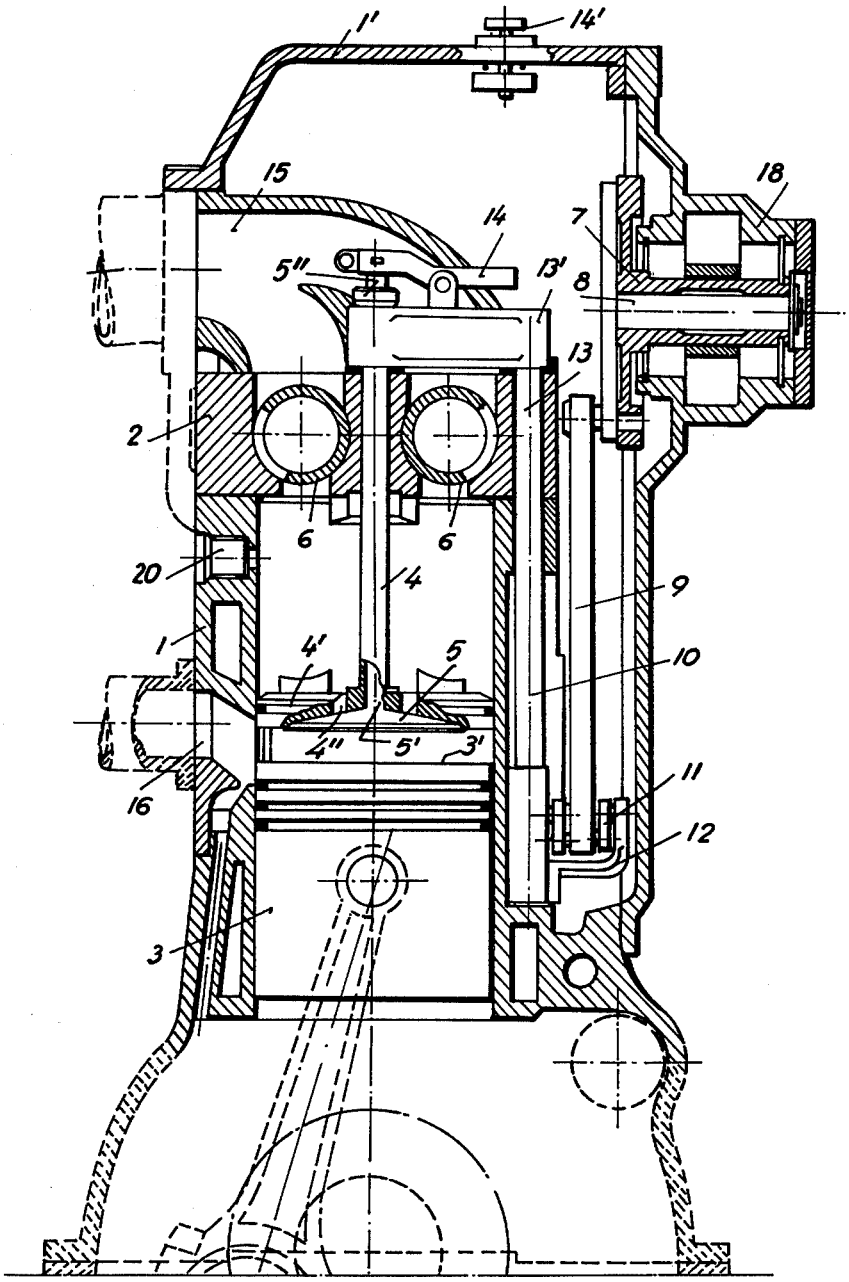
FIG. 3 is a view similar to FIG. 2 but with the main piston shown during its upward stroke.

From the said position of the crankshaft corresponding to about 120° rotation thereof until it has gone through its bottom dead center and has rotated through about 60 further degrees (the position shown in FIG. 3), the burned gases are exhausted through the exhaust port 16. At said position, 60° beyond the bottom dead center, auxiliary piston 4' and transfer valve 5 have reached the bottom end of their downward stroke, still separating the fresh sucked-in charge of combustible mixture from the burned gases.

Thereafter, auxiliary piston 4' and transfer valve 5 begin their upward stroke, together with main piston 3 which also is moving upwardly, and said auxiliary piston 4' and transfer valve 5 produce the compression of the combustible mixture, since now the rotating valves 6 are closed, and they progressively increase the speed of their upward movement with respect to the speed of main piston 3. The exhaust port 16 is now closed by the piston, transfer valve 5 opening transfer ports 4''. Thus, the compressed mixture contained in the cylinder space above auxiliary piston 4' rushes through ports 4'' into the cylinder space formed between the lower face of auxiliary piston 4' and main piston head 3', since said first mentioned space is contracting and said second mentioned space is expanding. Thus there will be a suction effect in the direction from said first mentioned space to said second mentioned space.

Auxiliary piston 4' reaches its top dead center and remains there before main piston 3 while this later is moving upwardly, compressing again the mixture. When main piston 3 reaches its top dead center, the cycle has been completed and the components of the engine are again in the same primitive position, ready to start the next cycle.

The skilled in this art will readily understand that while a specific and prefered embodiment of the present invention has been herein described and illustrated, it is obviously possible to introduce some changes of minor importance which however will be encompassed by the true spirit and scope of the invention as defined in the following claims.

I claim:

1. A two-stroke-cycle engine comprising at least one cylinder having a cylinder head, a main piston reciprocatingly arranged within each cylinder and associated with the engine crankshaft by means of a main connecting rod, at least one intake valve arranged between the intake manifold and the upper space within said cylinder, an auxiliary piston arranged within said cylinder and having an external hollow stem freely slidably mounted in said cylinder head, said auxiliary piston having at least one transfer port, a transfer valve having an internal stem freely slidably mounted within said external hollow stem, the free end of said internal stem protruding beyond the free end of said external stem, said transfer valve being capable, with respect to said auxiliary piston, of adopting two positions, in the first of which is closes said transfer ports and in the second of which it opens them, driving means capable of driving said external stem in a predeterminately variable synchronizing relationship with the crankshaft rotation and comprising a crank and auxiliary connecting rod mechanism, means capable of driving said transfer valve to said first position when the assembly of both said stems reaches the top bottom center, a spark plug arranged in the upper portion of the cylinder, and an exhaust port provided in the side wall of the cylinder at a point thereof slightly above the position of the upper edge of the main piston when this later is in the bottom dead center of its stroke.

* * * * *